United States Patent [19]

Lafortune et al.

[11] Patent Number: 4,500,006

[45] Date of Patent: Feb. 19, 1985

[54] SAFETY CLOSURE CAP

[76] Inventors: Lucien Lafortune, 11510 Pasteur St., Montreal, Canada, H3M 2P2; André Rouette, 12 du Vallon St., Saint-Sauveur-des-Monts, Canada, J0R 1R0

[21] Appl. No.: 605,221

[22] Filed: Apr. 30, 1984

[51] Int. Cl.[3] ..... B65D 55/02; B65D 85/56; A61H 1/00

[52] U.S. Cl. ..... 215/224; 215/305; 220/281

[58] Field of Search ..... 215/224, 225, 301; 220/281

[56] References Cited

U.S. PATENT DOCUMENTS

| | | | |
|---|---|---|---|
| 1,580,544 | 4/1926 | Spengher | 215/301 |
| 3,934,745 | 1/1976 | Lovell | 215/224 |
| 4,187,953 | 2/1980 | Turner | 215/301 |
| 4,442,945 | 4/1984 | Sandhaus | 215/301 |

FOREIGN PATENT DOCUMENTS

| | | |
|---|---|---|
| 869854 | 5/1971 | Canada . |
| 967913 | 5/1975 | Canada . |
| 1010821 | 5/1977 | Canada . |
| 1016107 | 8/1977 | Canada . |

*Primary Examiner*—George T. Hall

[57] ABSTRACT

A safety closure cap and container is disclosed. The container is of vial variety having an open top and two vertically-spaced annular protuberances at its upper portion defining a groove therebetween. The cap is circular, having an inverted central dome and a wide outer annular portion integrally formed with a downwardly extending flange. The latter is formed with an inward projection adapted to releasably snap into the groove and includes a plurality of vertical slots circumferentially spaced-apart. The underside of the cap is formed with a fulcrum ridge and a fluid-proof sealing ridge.

5 Claims, 6 Drawing Figures

SAFETY CLOSURE CAP

FIELD OF THE INVENTION

The present invention relates to closures for vials or other similar containers, more specifically to a novel and improved safety cap for such containers.

BACKGROUND OF THE INVENTION

Small containers were and are used to package various pharmaceutical substances such as medicines, common aspirin and pills. The recognized danger, of course, was that the caps and lids for such containers were previously not of the safety type and could be removed by small children. Efforts were consequently directed to the development of safety caps which can only be opened in a way impossible for young children or other people to open without knowing the opening technique.

Unfortunately, these efforts produced closure devices which are still not entirely satisfactory. The existing safety closures can be categorized into three groups:

(a) the "palm and twist" types which, although they are impossible for small children to open, present a problem for elderly or handicapped persons because of the applied strength needed;

(b) the "overcap" types which tend to be very expensive and of complex construction because two separate cap parts are used; and (c) the "deformable" types which generally include a flexible central portion and a deformable peripheral skirt which is released from the upper portion of the container by pressing on the central portion of the cap closure.

Of these three types only type (c) can be considered as potentially the most pertinent because of the above-noted disadvantages inherent in the first two types. For example, the Canadian patent issued to Paul A. Marchant on Aug. 23, 1977, No. 1,016,107 teaches a safety cap characterized by a depressible central circular section 17 and a skirt section 20. When section 17 is depressed downwardly, the skirt 20 is deformed radially outwardly to clear its shoulder 21 from the shoulder 12 of the vial. The drawback of the Patent is that a truly fluid-proof closure is not obtained.

Another Canadian patent issued to Peter A. Vercillo on May 20, 1975 and bearing No. 967,913 discloses another cap, of relatively complicated design, which features a depressible central area and a depending skirt. The cap, however, is dependent in its functionning on the material out of which it is made: this material must be one exhibiting a slot rate of "creep return". In other words, the cap must be removed while the peripheral skirt is in expanded deflected condition and slowly returning to its normal configuration. There is thus an undesirable period of time while the container is not sealingly shut during removal or positioning of the closure cap. Moreover, the safety closure of this patent is of relatively complicated construction as can be seen by referring to the drawings.

Another Canadian Pat. No. 869,854, issued on May 4, 1971 to Lloyd S. Turner discloses a closure cap having a dome-shaped central portion and an integrally-formed downwardly extending peripheral skirt. When dome 17 is subjected to downward pressure the skirt portion 16 expands slightly. Yet, as admitted in the specification of this patent (cf. p. 5, lines 8–14), sometimes a secondary lateral pressure must sometimes be effected against the skirt to ensure the latter properly clears the curved area 13 of the container. There again, no fluid-proof sealing is achieved.

Finally, in the review of the prior art, the U.S. patent issued to Lovell on Jan. 27, 1976 and bearing U.S. Pat. No. 3,934,745 discloses another safety bottle cap belonging to type (c). This patent features another central dome and a downwardly extending skirt portion. An annular ridge 36 is further provided adjacent the upper lip of the container. In theory, depressing the central dome of this patent will cause skirt 24 to expand outwardly, as in previous patents discussed, with ridge 36 acting as a fulcrum for skirt 24. In fact, it has been found that the patent does not function as described: ridge 36 which is intended to form a seal, actually comes to abut against the inner upper surface of container 10 and, contrary to what is intended, really prevents skirt 24 from opening sufficiently outwardly to remove the cap. Fulcrum 36 must be free to slide for proper removal of the cap which it cannot do according to the construction disclosed.

The main feature lacking in all the prior art discussed above is that none of the combinations of a container with a safety closure cap are specifically designed to be fluid-proof, except U.S. Pat. No. 3,934,745. However, the device of this patent cannot function properly.

OBJECTS OF THE INVENTION

In view of the above it is a prime object of the present invention to provide a safety closure cap in combination with a container wherein the cap can be attached to or removed from its container in one simple operation.

It is another important object of the invention to provide a safety cap of the character described which, in combination with its container, is fully fluid-proof.

It is yet another object of the invention to provide a safety cap and container of the character described which is simple in design and non-costly to produce.

SUMMARY OF THE INVENTION

In general, the invention is comprised of the combination of a safety cap and container. The safety cap is made of a flexible resilient material having a desired density and is of one piece. The cap has a central circular area which is preferably concave and which merges with a substantially wide annular portion, the latter terminating and integrally formed with a downwardly extending flange. This flange is almost continuous and has at its lower end an inwardly directed projection. The lower surface of the annular portion is provided with a circular ridge adapted to rest on the upper rim of the container when the cap is attached thereto in its unstressed condition, thereby serving as a slightly slidable fulcrum when the central area is pressed in towards the container.

Preferably, the thickness of the cap is substantially thinned at the juncture between the central area and the annular portion.

The container of the invention is generally cylindrical, having an open top end and made of suitable rigid material. At its top end the container is formed with a flat horizontal rim, the outer circumference thereof being inclined downwardly and outwardly defining a slanted wall portion. A first circular protuberance is formed at the lower end of the slanted wall portion, which protuberance has a slanted side generally of the same slope as the slanted wall portion. The protuberance at its underside defines a flat annular plane which engages the projection of the cap flange.

Preferably, the container is further formed with a second protuberance spaced below the first protuberance, the two defining between them a continuous groove. According to the preferred embodiment, the side of the second protuberance is extended far enough outwardly to be substantially of the same diameter as the outer surface of the cap flange. This effectively precludes any attempt to insert a fingernail or tool under the projection of the flange to pry the latter away from the container.

The invention includes two other features. The more important feature is a sealing means between the cap and its container, accomplished by a second annular ridge formed at the underside of the cap's annular portion and located radially outwardly of the first ridge. The second ridge is continuous and is adapted to sealingly engage the slanted wall portion of the container to provide a fluid-proof seal.

The other feature consists of a plurality of equally-spaced vertical slots formed in the flange of the cap and extending radially inwardly an appreciable distance into the annular portion of the cap at their upper ends and to the inner end of the projection at their lower ends. These slots enable the flange of the cap to deform outwardly more easily when the central area is pressed downwardly.

BRIEF DESCRIPTION OF THE DRAWINGS

The foregoing will be more clearly understood by having referral to the preferred embodiment of the invention, illustrated by way of the accompanying drawings, in which.

Like numerals indicate like elements throughout the drawings.

DETAILED DESCRIPTION OF THE PREFERRED EMBODIMENT

Figure 1:
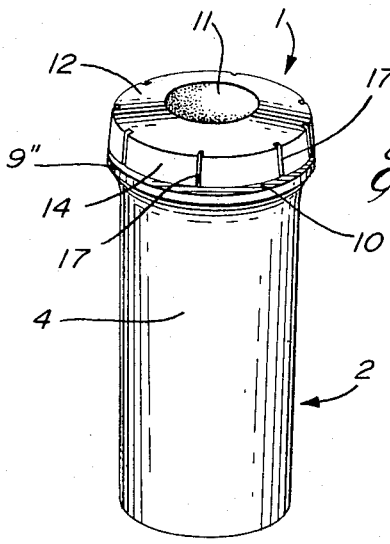
FIG. 1 is a perspective view of the safety cap and its container.
Figure 2:
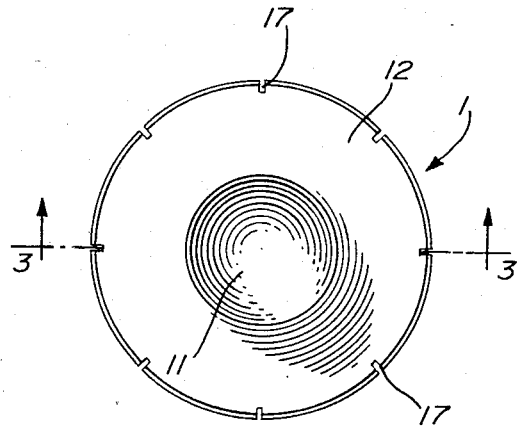
FIG. 2 is a top plan view of the safety cap and container.
Figure 3:
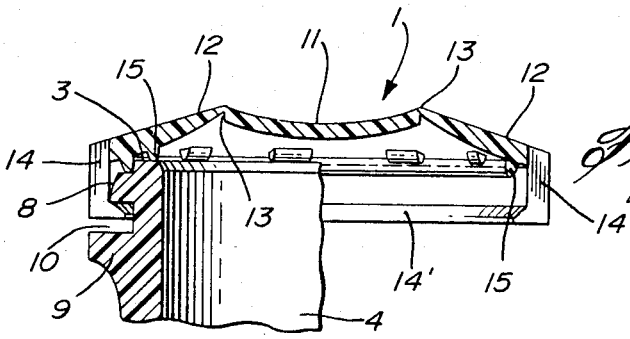
FIG. 3 is a cross-sectional view taken along lines 3—3 of FIG. 2 and showing the container partially broken away.
Figure 5:
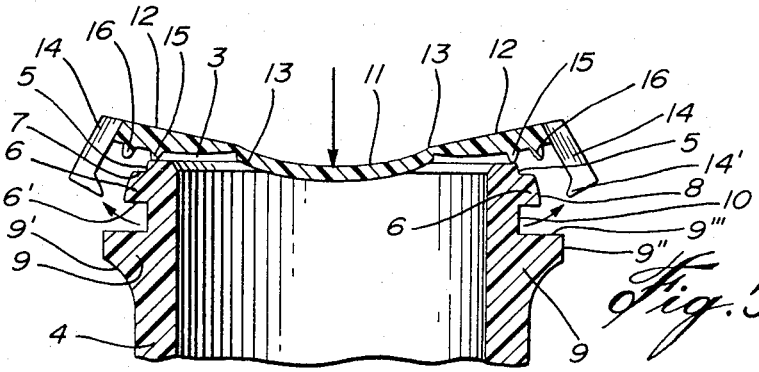
FIG. 5 is a cross-sectional view taken along lines 5—5 of FIG. 4.
Figure 6:
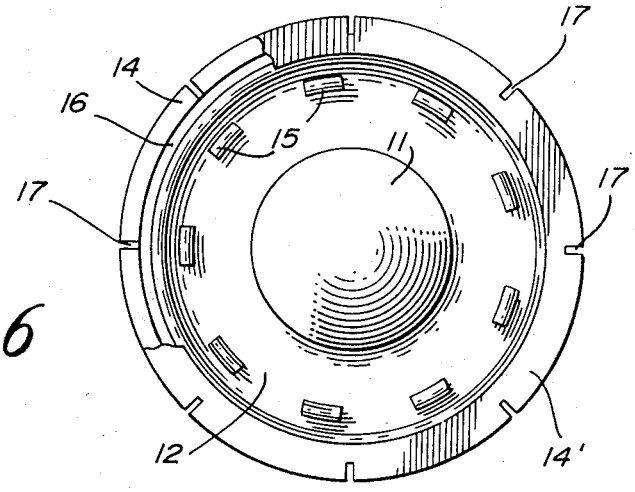
FIG. 6 is a bottom plan view of the safety cap being partially broken away to show the details of construction.

The invention comprises the combination of a safety cap 1 and container 2. Referring to FIGS. 1, 3 and 5, container 2 is shown, being of a cylindrical shape rigid and having a bottom wall and an open top. The latter is formed of a circumferential flat and horizontal rim 3 which preferably has a width slightly less than the thickness of the container wall 4.

The outer circular edge of rim 3 falls away downwardly and slightly outwardly to form a slanted wall portion 5. At the lower end of the latter a first protuberance 6 is formed, having a horizontal step 7, a slanted side wall 8 having generally the same slope as wall portion 5, and a flat annular bottom surface 6'.

Container 2 is further provided with a second protuberance 9 spaced downwardly from the first protuberance 6. Thus, the two protuberances 6 and 9 define between them a cross-sectionally rectangular groove 10. Second protuberance 9 includes a lower upwardly, outwardly curved portion 9', a vertical side portion 9'' and a flat horizontal shoulder 9''', as best seen in FIG. 5.

Referring now to all the figures, safety cap 1 is shown, being of a circular shape. Cap 1 includes a central area in the shape of an inverted dome 11 made of resilient deformable material such as one of the plastics. Merging with dome 11 is a wide annular portion 12 which is radially outwardly downwardly inclined. When cap 1 is in its undeformed condition, the center of the dome 11 is located slightly above the rim of container 2 (cf. FIG. 3). At the merger of dome 11 with annular portion 12, the material of the cap is substantially thinned at 13 to provide a more flexible joint.

The circumference of annular portion 12 is integrally formed with a downwardly extending vertical flange 14. Flange 14 has at its lower end an inwardly directed projection 14' thereby defining an upwardly outwardly inclined surface which is adapted to snap into contact with the outer corner of bottom surface 6' of groove 10, as best seen in FIG. 3.

Preferably, the outer surface of flange 14 is aligned with side portion 9'' of second protuberance 9 to effectively prevent the insertion of a tool or fingernail therebetween to pry off cap 1, as is known.

The underside of annular portion 12 is formed with a first rim contacting ridge 15 which may be circularly continuous or more advantageously made in a plurality of circularly spaced-apart segments as illustrated. It will be clear that, as dome 11 is depressed downwardly in the direction of the arrow of FIG. 5, ridge segments 15 will tend to slide a certain distance radially outwardly along rim 3 at the same time acting as a fulcrum for flange 14.

Embodying an essential feature of the invention is a sealing means between the safety cap and its container, consisting of a second ridge 16, circular and continuous, projecting downwardly also from the underside of annular portion 12. Ridge 16 is spaced radially outwardly of the first ridge 15 and is adapted to sealingly engage slanted wall portion 5 of container 2 and horizontal step 7 when the cap 1 is secured to the container.

Figure 4:
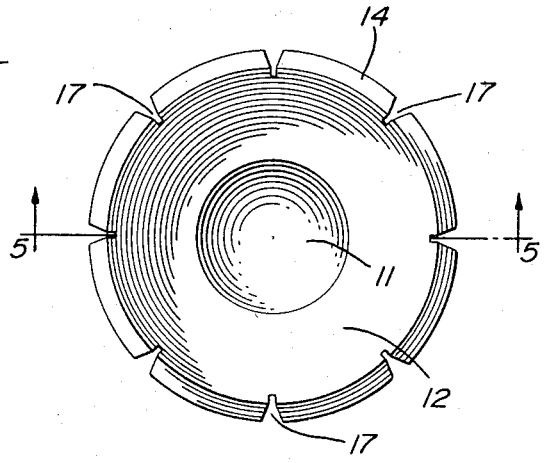
FIG. 4 is a top plan view wherein the flange of the safety cap is shown in outwardly deformed condition.

Referring finally to FIGS. 1, 2, 4 and 6, there is shown cap 1 in various views and including a plurality of circumferentially-spaced vertical slots 17 formed in flange 14. Each slot 17 is of a sufficient depth to extend into annular portion 12 at its upper end and to the inner end of projection 14' at its lower end. As FIG. 4 shows clearly, the slots 17 allow a uniform and pronounced outward deformation of flange 14 when the dome 11 is depressed downwardly such that projection 14' will be freed from groove 10.

What I claim is:

1. In a container and a safety cap adapted to close the container in fluid-proof relationship, the combination comprising a rigid container having an open top with a horizontal flat rim; said rim joining at its outer edge with a downwardly and outwardly inclined slanted wall portion; at least one circular protuberance formed at the lower end of said slanted wall portion, at the upper portion of the container wall and defining a flat step, and at its underside, a flat annular plane having an outer corner; said safety cap having a deformable central area merging with an annular portion; the outer circumference of the latter being integrally formed with a vertical downwardly extending flange; said flange having an inwardly directed projection at its lower end adapted to releasably snap into locking engagement with said outer corner; said annular portion having a lower surface provided with a first circular ridge adapted to abut against said rim in the closed condition of said cap; and being further provided with a second continuous ridge radially outwardly-spaced from said first ridge and adapted to sealingly contact said slanted wall portion to provide a fluid-proof seal between said safety cap and said container.

2. The combination as set forth in claim 1, wherein said central area is in the shape of an inverted dome and the material at the juncture of said dome and said annular portion is substantially thinned.

3. The combination as set forth in claim 2, wherein said first circular ridge is discontinuous, being formed of a plurality of mutually spaced segments.

4. The combination as set forth in claim 3, wherein said upper portion of said container is formed with a second protuberance, downwardly-spaced from said first protuberance, said first and said second protuberance defining between them a continuous groove; said second protuberance having an outer side of substantially the same diameter as the outer surface of said flange, whereby said flange cannot be pried loose from said container; said side being inclined at the same slope as said slanted wall portion.

5. The combination as set forth in claim 2, wherein flange is formed with a plurality of mutually-spaced vertical slots, each having an upper end and a lower end, said upper end extending into said annular portion and said lower end extending to the inner end of said projection.

* * * * *